US006084492A

United States Patent [19]

Cereda et al.

[11] Patent Number: 6,084,492

[45] Date of Patent: Jul. 4, 2000

[54] MAGNETIC ACTUATOR

[75] Inventors: Carlo Cereda, Caravaggio; Giorgio Moriconi, Torre Boldone; Giulio Secondo, Genoa, all of Italy

[73] Assignee: ABB Research Ltd., Zurich, Switzerland

[21] Appl. No.: 08/968,438

[22] Filed: Nov. 12, 1997

[30] Foreign Application Priority Data

Nov. 11, 1996 [IT] Italy ..... MI96A2328

[51] Int. Cl.[7] ..... H01F 7/00

[52] U.S. Cl. ..... 335/229; 335/220

[58] Field of Search ..... 335/220, 227, 335/228, 229, 230, 234, 236

[56] References Cited

U.S. PATENT DOCUMENTS 3,178,151 4/1965 Caldwell ..... 335/229
3,381,181 4/1968 Weathers .
3,783,423 1/1974 Mater et al. ..... 335/174
4,422,060 12/1983 Matsumoto et al. ..... 335/256
4,751,587 6/1988 Green, Jr. ..... 335/234

FOREIGN PATENT DOCUMENTS 43 04 921 C1 8/1994 Germany ..... H01H 33/38

*Primary Examiner*—Lincoln Donovan
*Attorney, Agent, or Firm*—Bryan Cave LLP

[57] ABSTRACT

A bistable permanent-magnet actuator is disclosed having a tailored switching/position force characteristic, with an adequate, modifiable holding force in the end positions. The actuator is characterized in that the yoke is formed by two parts that are mounted so as to face each other and are separated by two gaps. The dimensions of the air gaps may be tailored to obtain intended characteristics.

8 Claims, 2 Drawing Sheets

MAGNETIC ACTUATOR

BACKGROUND OF THE INVENTION

The present invention relates to an electromagnetic or magnetic actuator, particularly for actuating circuit breakers in electric power distribution networks.

More specifically, the present invention relates to an actuator of the bistable type, i.e., having two fixed positions, each of which can be maintained permanently, and comprising at least one permanent magnet. Preferably, the actuator according to the invention is used to actuate a gas-insulated (e.g. $SF_6$) circuit breaker.

Bistable electromagnetic actuators, by means of the presence of permanent magnets in their structure, are capable of applying considerable holding force in the two positions, and this force must be overcome in order to move the actuator element.

It is therefore necessary to generate an intense magnetic field, usually by means of windings, in order to overcome the field of the permanent magnets and produce a sufficiently intense separation force.

Documents of the prior art disclose a bistable actuator of the permanent-magnet type, which comprises a magnetic yoke having a laminar structure, at least one permanent magnet, an armature which can move axially between a first stable position and a second stable position, and means for moving the armature between said first and said second stable positions. The locus of the force/position characteristics is plotted in FIG. 3. Prior art actuators are generally focused on the solution of problems deriving from the need of having a high holding force, without considering problems associated with friction forces.

One problem of magnetic actuators arises from the mechanical force/position characteristic generated by the mechanism to be actuated, and in particular from the friction forces which are associated with the breaker being actuated and which must be overcome for the correct operation of said devices.

The friction forces are static and/or dynamic forces and may be present only in particular sections of the stroke of the armature. The presence of friction forces is particularly evident in gas-insulated circuit breakers, due to the kind of the electrical contacts in this type of circuit breakers.

Moreover, said friction forces are not generally symmetrical, and this entails the need to have different characteristics of the actuator when passing from the open position to the closed position and vice versa, while the holding force is relatively less important.

For these reasons, conventional actuators are oversized; this negatively affects the costs of the actuator, making it often more economical to resort to conventional spring-loaded mechanical actuators.

SUMMARY OF THE INVENTION

The aim of the present invention is to solve the above described technical problem, overcoming the limitations of the prior art, and particularly to provide a bistable magnetic actuator which has a tailored switching/position force characteristic, with an adequate holding force in the end positions, and at the same time has a relatively low cost.

This aim is achieved by the present invention, which consists of an actuator characterized in that the yoke is formed by two parts which are mounted so as to face each other and are separated by two gaps.

Further advantageous characteristics are set forth in the appended claims.

In particular, the present invention provides for the presence of air gaps in the magnetic circuit, the dimensions of which can be easily changed during design in order to obtain the intended characteristics. For example, it is possible to privilege the achievement of a maximum initial actuation force, or of a force which reaches its peak halfway along the actuation or is minimum in one position and maximum in the other, and so forth.

Another characteristic that can be easily achieved by acting only on the geometric structure of the actuator is the asymmetry of the behaviour of the actuation force during actuation in one direction with respect to the other.

A further characteristic is that also the holding force can be modulated according to the needs.

BRIEF DESCRIPTION OF THE DRAWINGS

The present invention is now described with reference to the accompanying drawings, which relate to preferred but non-limitative embodiments thereof and wherein.

DESCRIPTION OF THE PREFERRED EMBODIMENTS

Figure 1:
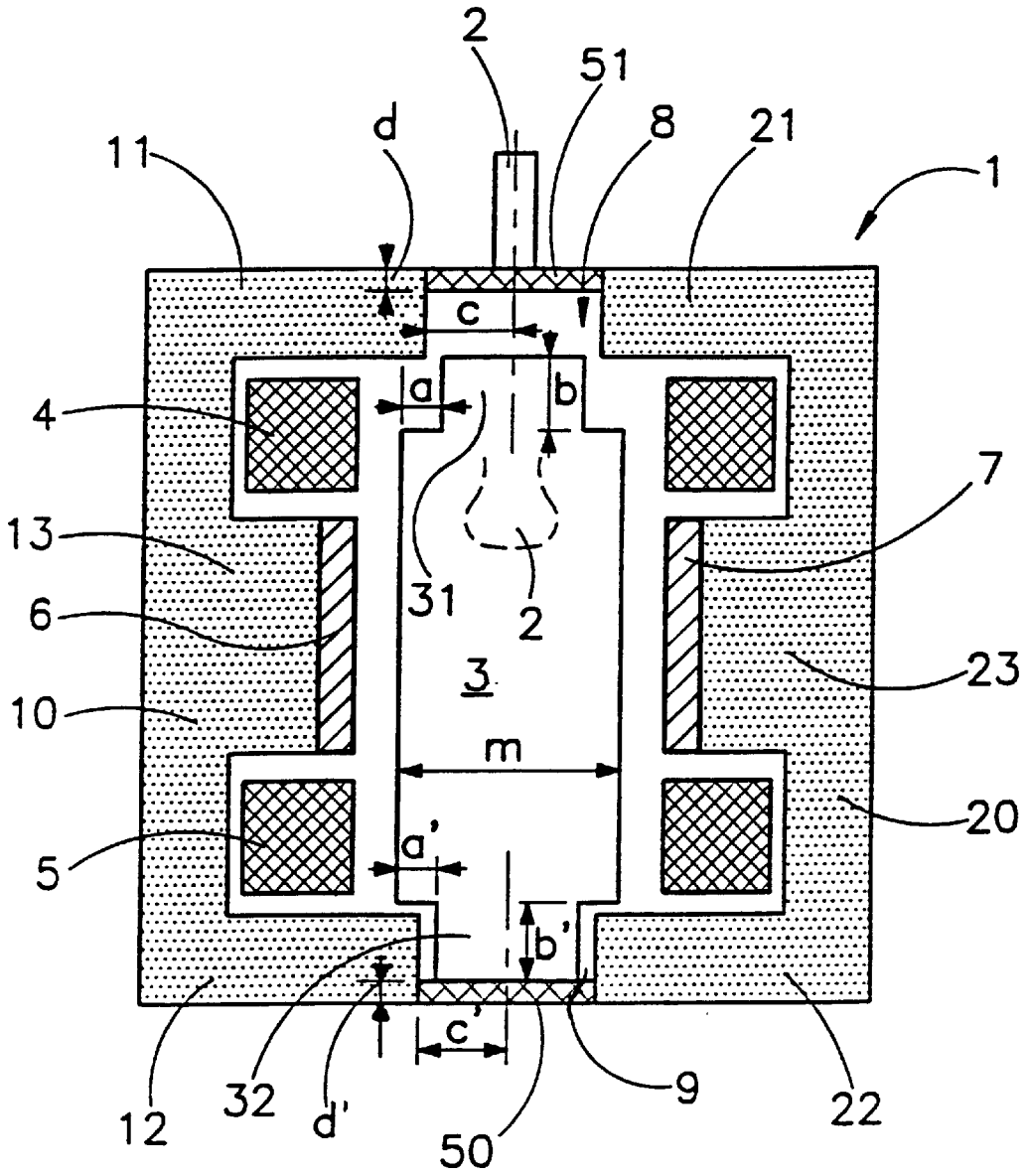
FIG. 1 is a transverse sectional view of an actuator according to the present invention.
Figure 2:
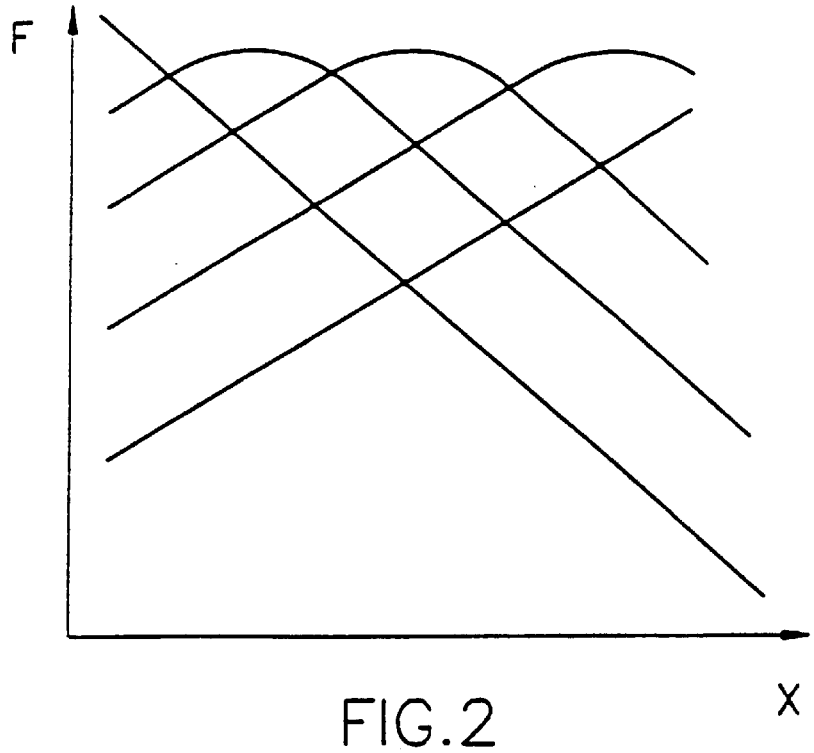
FIG. 2 plots some of the force/position characteristics of an actuator according to the invention.
Figure 3:
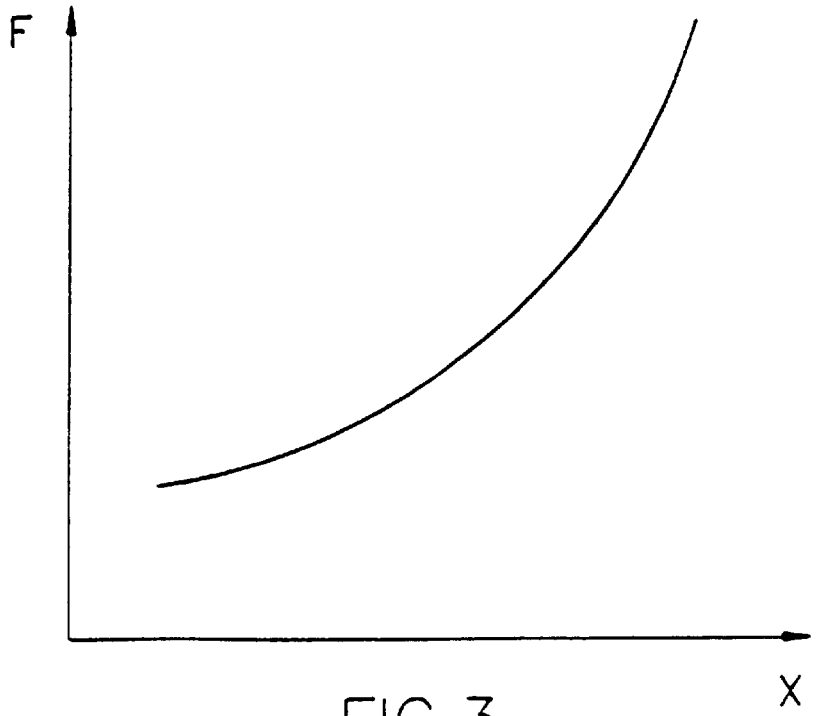
FIG.3 (PRIOR ART)
FIG. 3 plots the force/position characteristic of an actuator of the prior art.

With reference to FIG. 1, the actuator according to the present invention comprises a magnetic yoke 1, an armature 3 which can move within a space defined by the yoke, and a connecting rod 2 fixed to the armature and adapted to move the moving part of a circuit breaker in order to open and close it.

The yoke 1 is formed by two core parts 10 and 20, each of which is E-shaped; their two horizontal arms, designated by the reference numerals 11 and 21 (12, 22) respectively, are identical and are preferably narrower than the central arms 13 and 23.

The two core parts 10, 20 of the yoke are mounted on a support (not shown), so that the end surfaces of the horizontal arms face each other but are separated by distances 2*c* and 2*c*'. Accordingly, two air gaps 8, 9 are formed which may have the same length (if c=c') and which the end parts of the armature can enter, as described hereinafter.

Two permanent magnets, designated by the reference numerals 6 and 7 respectively, are fitted on the facing surfaces of the two intermediate arms 13 and 23 and ensure the holding force for bistable operation; inside the yoke 1 there are also two windings 4 and 5.

The coils or windings 4 and 5, inserted respectively between the intermediate arms 13, 23 and the outer arms 11, 12 and 21, 22 of the yoke 1, provide the actuation force when they are supplied with an unidirectional current.

The armature 3 comprises a central body, which is substantially shaped like a parallelepiped and has a width m, and two end parts 31 and 32, which are made of ferromagnetic material and are adapted to enter one of the two gaps 8, 9 at said two stable positions. Said end parts can be narrower than the central body 3, i.e., they have a step which has a width a (a').

The end part 31 of the armature 3 has a height b and a width (m-2*a*), and the end part 32 of the armature has a height b' and a width (m-2*a*'), while the thickness or depth of both is substantially equal to the thickness of the yoke 1. The shape and dimensions of the end parts 31 and 32 (i.e., a,a',b, and b') can be modified in order to have the desired gap between end parts 31, (32) and the arms 11,21, (12,22), respectively.

According to the invention, the sum of the difference in width (2*a*) at one end of the armature 3 and of the width (2*c*) of the gap meant to accommodate said end is preferably constant. In other words, for each gap 8, 9, the sum of the (m-2*a*) or (m-2*a*') of the end portion of the armature and of the length of the corresponding gap (c or c') is equal to a preset constant.

Briefly:

$$m-a+c=K,$$

and $$a+c=K1$$

This accordingly allows extreme flexibility in execution.

The armature 3 can be formed as a solid part made of ferromagnetic material or preferably with a laminated structure by means of superimposed laminations.

According to alternative embodiments, one or both of the end parts of the armature 3 can have the same width as the body, i.e., a and a' can be equal to zero, and the armature can thus assume the shape of a parallelepiped. The width of the gaps 8 and 9 is correspondingly increased in order to accommodate these modified shapes of the end portions.

The arrangement of the invention, in which the two E-shaped parts of the yoke are not in contact each other but are separated by gaps 8 and 9, allows a concentration of the flux produced by the coils 4 and 5.

When the armature is in the lower stable position, as shown in FIG. 1, the end part 31 is sufficiently close to arms 11,21, thereby reducing the energy required for initiating movement (i.e., detatching); at the same time, the holding force generated by the permanent magnets is relatively low and is a function of the distance (m-2*c*'). Therefore, by suitably dimensioning the armature and the end parts, the actuator can be tailored according to the needs. The same applies when the armature is in the upper stable position.

The initial positions are set by two inserts made of nonferromagnetic material 50 and 51, which have dimensions d and d' which are generally different and must be determined appropriately on the basis of the intended force/position characteristics.

What is claimed is:

1. A bistable permanent-magnet actuator comprising a magnetic yoke; at least one permanent magnetic; an armature which can move axially between a first position and a second position; means for moving the armature between a first position and a second position inside said yoke, wherein said yoke is formed by first and second E-shaped core parts each having two horizontal outer arms and an intermediate arm, wherein the core parts are mounted in a mutually facing position on opposite sides of the armature and are separated by two gaps defined between the mutually facing horizontal outer arms, wherein the armature comprises a central body which is shaped like a parallelepiped having two end parts adapted to enter one of the two gaps at the first and second positions.

2. An actuator according to claim 1, wherein for each gap, the sum of the width of an end part of the armature and of a length of a corresponding gap is equal to a constant value to be determined.

3. An actuator according to claim 2, wherein the lengths of the gaps are identical.

4. An actuator according to claim 1, wherein the widths of end parts of the armature are equal.

5. An actuator according to claim 1, further comprising two permanent magnets, each one of said permanent magnets being mounted on the mutually facing surfaces of the intermediate arms.

6. An actuator according to claim 1, wherein the means for moving the armature comprises two windings accommodated respectively between the intermediate arms and the outer arms of the core parts of the yoke.

7. An actuator according claim 1, wherein the first and second parts and the armature have a laminar structure.

8. An actuator according to claim 1, further comprising two inserts made of nonferromagnetic material for setting initial positions of the armature inside the yoke.

* * * * *